US005702032A

United States Patent [19]

Loehrke

[11] Patent Number: 5,702,032

[45] Date of Patent: Dec. 30, 1997

[54] BEVERAGE DISPENSING SYSTEM WITH BOTTLE IDENTIFICATION RINGS

[75] Inventor: John M. Loehrke, Windsor, Wis.

[73] Assignee: DEC International, Inc., Madison, Wis.

[21] Appl. No.: 563,161

[22] Filed: Nov. 27, 1995

[51] Int. Cl.[6] ..... B67D 5/08

[52] U.S. Cl. ..... 222/63; 222/641

[58] Field of Search ..... 222/1, 129.1–129.4, 222/640, 641, 5, 63

[56] References Cited

U.S. PATENT DOCUMENTS

| | | |
|---|---|---|
| 3,688,947 | 9/1972 | Reichenberger . |
| 3,802,606 | 4/1974 | Gust . |
| 3,920,149 | 11/1975 | Fortino et al. . |
| 3,993,218 | 11/1976 | Reichenberger . |
| 4,660,742 | 4/1987 | Ozdemir . |

*Primary Examiner*—Gregory L. Huson
*Attorney, Agent, or Firm*—Quarles & Brady

[57] ABSTRACT

Each open liquor bottle in a tavern has a plastic spout with a magnetically operable valve to control the flow of liquor from the bottle. The spouts were fabricated with three integral rings extending around the spout with each ring being either plastic or metal to form a pattern that encodes information identifying a characteristic of the bottle. An annular actuator reads the pattern of rings and responds by producing a magnetic field that opens the spout valve to dispense the liquor. Three rings allow up to eight different classes of characteristics to be encoded. To increase that number of classes a supplemental metal ring is attached around some of the spout adjacent to one end of the actuator when the spout is inserted therein. The actuator is modified to sense presence of the supplemental metal ring on a spout. Adding another ring to certain spouts permits the number of classes of characteristics to be doubled without requiring replacement of existing spouts in a tavern.

14 Claims, 3 Drawing Sheets

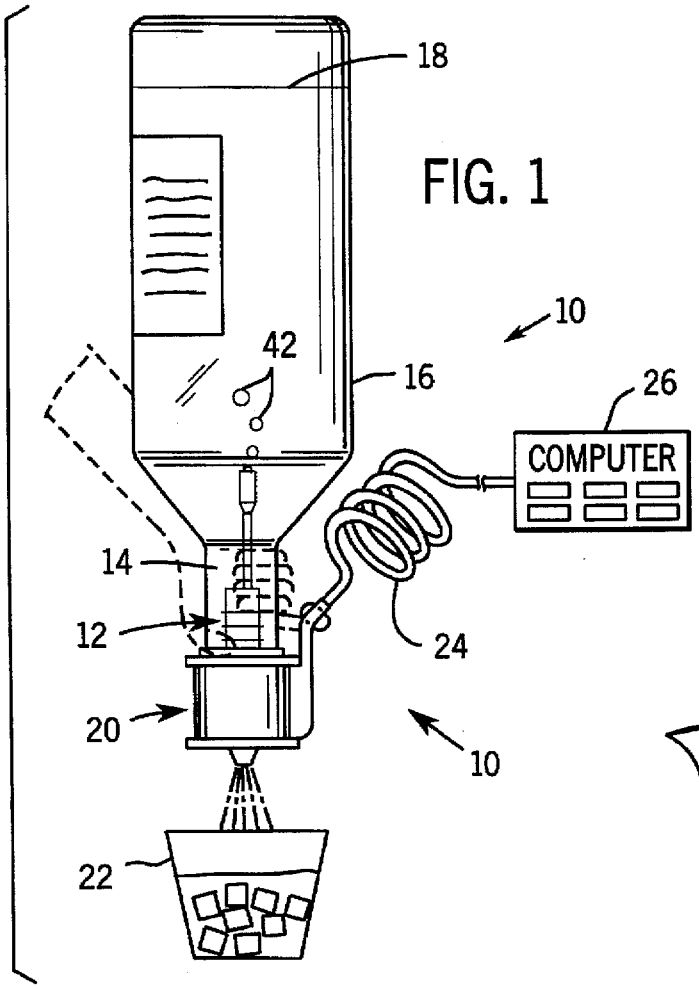
FIG. 1
FIG. 2
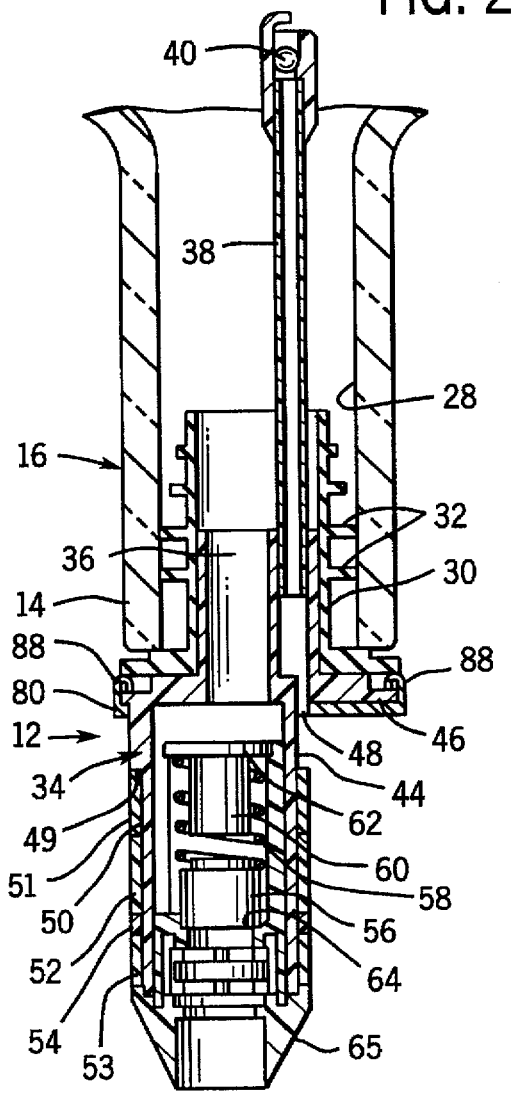

BEVERAGE DISPENSING SYSTEM WITH BOTTLE IDENTIFICATION RINGS

BACKGROUND OF THE INVENTION

The present invention relates to systems for dispensing beverages from bottles, and more particularly to systems for dispensing measured amounts of liquid from a bottle and accounting for the quantity and cost of the liquid so dispensed.

A bartender commonly pours liquor from a bottle into a glass in which a drink is being mixed. A spout is often attached to the mouth of the bottle to dispense the liquor at a relatively constant flow rate so that a bartender can "free pour" the liquor without the need for a measuring device, such as a jigger. Even at a constant flow rate, the exact amount of liquor poured into each drink varies depending upon the bartender, and varies from drink to drink poured by the same bartender. Such variation affects the profits derived from a given bottle of liquor. In addition, simple bottle spouts do not provide any mechanism to ensure that each drink dispensed from a bottle was rung up on the cash register. Thus, a bartender has been able to serve free or generous drinks to friends and preferred customers without accounting to the tavern management.

In response to these problems, more sophisticated liquor dispensing equipment has been devised. One such system is described in U.S. Pat. No. 3,920,149 and provides each bottle with a spout that has a magnetically operated valve. When liquor was to be poured from a given bottle, its spout was placed inside an actuator connected to a computer via a cable. When the bottle and the actuator were inverted, a tilt switch closed causing an electromagnetic coil in the actuator to be energized which opened the valve in the spout. The valve was held open for a defined period of time which dispensed a given volume of liquor because of a relatively constant flow rate through the spout. When that time period ended, the electromagnetic coil was de-energized by the computer and the valve closed.

Three rings were provided on the outside of the spout and by selecting either metal or plastic material for each ring, the price of a drink can be encoded as three binary digits and read electromagnetically by the actuator. The dispensing computer provided the price data to a cash register which automatically tallied the amount of money owed by the customer. However, the size of the spout accommodated only three rings which limited the number of different price classes to eight. It is desirable to provide a greater number of rings and thus more classes. Although it is possible to enlarge the spout to accommodate additional rings, a tavern would have to replace all the spouts and actuators in order to increase the number of drink classes. In a large facility, such as a hotel, where these automated systems have greatest appeal, scores of spouts would have to be replaced, thus being a drawback to changing systems merely to provide more price classes.

SUMMARY OF THE INVENTION

A general object of the present invention is to provide a mechanism for automatically dispensing a predefined quantity of beverage from a container.

Another object is to provide a mechanism for automatically determining a classification assigned to the beverage being dispensed.

A further object of the present invention is to provide a mechanism for retrofitting previously installed dispensing systems to provide a greater number of classifications without having to replace existing bottle spouts.

These objects are satisfied by a beverage dispensing system in which each beverage bottle has a spout with a flow passage controlled by a magnetically operable valve. Each spout includes a plurality of integral rings with each one selected from either metal or plastic to encode a classification for the beverage in the bottle to which the spout is attached. The valve is operated by an actuator that is placed near to the spout in order to dispense liquid. The actuator includes a valve operating coil that when energized produces a magnetic field which opens the valve. An interrogator reads the pattern of metal and plastic rings on a spout and thereby determines the classification of the beverage in the bottle. For example, the interrogator may comprise a separate sensing coil for each ring and circuitry that detects the inductive loading of each sensing coil to determine whether a metal ring is adjacent to the sensing coil.

In order to increase the number of possible classifications, a supplemental ring of magnetic material is attached to the exterior of selected spouts that are to be encoded with one of the additional classifications. Specifically, the supplemental ring has an opening through which part of the spout extends and a fastener is secured to the spout exterior so as to be adjacent the interrogator when the spout is inserted into the actuator during the dispensing operation. In the preferred embodiment, the supplemental ring has a annular plate that is placed against an exterior flange on the spout. A plurality of tabs extend from the plate and are bent around an edge of the flange to fasten the supplemental ring to the spout.

The interrogator is modified with an additional mechanism, such as another sensing coil, to detect the presence or absence of a supplemental ring on a spout during beverage dispensing. Thus an existing dispensing system in a tavern can be modified to accommodate twice as many beverage classifications by replacing the interrogator and adding supplemental rings to existing spouts that are to be placed in the additional classifications. This enables the existing spouts to remain in use.

BRIEF DESCRIPTION OF THE DRAWINGS

FIG. 1 pictorially illustrates a beverage dispensing operation utilizing the present invention;

FIG. 2 is a cross-sectional view of a spout which is part of the dispensing system in FIG. 1;

DETAILED DESCRIPTION OF THE INVENTION

Figure 3:
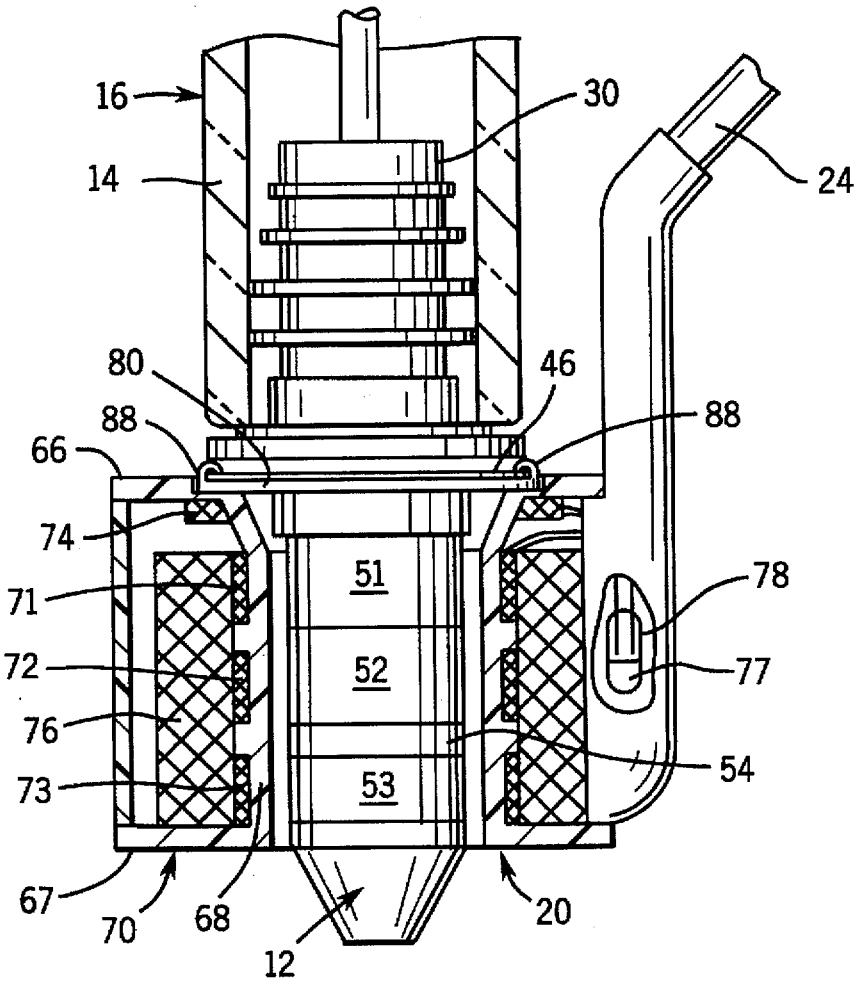
FIG. 3 is a view of an actuator attached to the spout and with the actuator shown in cross-section.

With initial reference to FIG. 1, a beverage dispensing system 10 comprises a spout 12 which is inserted into neck 14 of a liquor bottle 16. The spout 12 may be secured to the bottle by a sealing band (not shown) which prevents the unauthorized removal of the spout in order to dispense drinks without the use of the present system. As will be described, the spout 12 has an internal magnetically actuated valve which controls the flow of an alcoholic beverage 18 from the bottle. The valve within spout 12 is operated by an actuator 20 which opens the valve for a predetermined period of time to dispense a given volume of beverage into a glass 22 when the bottle is inverted as shown. The actuator 20 is connected via a cable 24 to a computer 26 which controls the beverage dispensing operation and accounts for the beverages.

The beverage dispensing system 10 finds special application as a means for pouring liquor from a number of bottles in a tavern and accounting not only for the volume of liquor served, but also the number of times a type of liquor is served. This is accomplished by sensing a code on each spout and using the sensed information to increment counters within the computer 26. This information can be used to determine the volume of liquor dispensed and the dollar amount which should have been collected for the sale of liquor at a particular bar station. Thus, at the end of a work day, for instance, the owner of a tavern can compare the total value of the dispensed liquor against the money collected in the cash register of the tavern.

With reference to FIG. 2, the spout 12 includes a plastic, tubular liner 30 making a liquid-tight junction between the spout and the inner surface 28 of the bottle neck 14. The liner 30 has a pair of outwardly extending flanges 32 which sealingly engage the inner surface 28 of the bottle neck 14. A non-magnetic plastic housing 34 includes an open end tube 36 which is press fit into the liner 30 and has a breather tube 38 extending outwardly therefrom through the inner open end of the liner 30. The remote end of the breather tube 38 extends into the bottle 16 and has a ball valve assembly 40 which prevents liquid from escaping through the breather tube 38 when a bottle is inverted and the spout valve is not yet open. When the spout valve is open, the breather tube 38 and ball valve 40 permit air to enter the bottle, as shown by bubbles 42 in FIG. 1, to replace the volume of beverage 18 which flows from the bottle. The spout housing 34 further includes a second tubular section 44 integral with an exterior flange 46 and extending outwardly therefrom in a direction opposite to the direction in which the first tubular section 36 extends. The second tubular section 46 is axially offset with respect to the spout liner 30 and the center of the exterior flange 46 to accommodate a breather hole 48.

The second tubular section 44 has an arcuate shoulder 49 defining a major portion 50 having a reduced outer diameter from the portion that is adjacent to exterior flange 46. This allows three annular coding rings 51, 52, and 53 to be secured around the recessed major portion 50. A non-magnetic plastic spacer band 54 also is placed around the spout 12 between coding rings 52 and 53.

Within the second tubular section 44 is a valve mechanism which includes a movable valve member 56. A compression spring 58 is positioned between the valve member 56 and a lug 60 which extends from an inward flange 62. The spring 58 biases the valve member 56 against a valve seat 64 closing the passage within the spout 12 through which the beverage otherwise would flow from the bottle 16 out of nozzle 65 of the spout. As will be described, the valve member 56 is made of a ferromagnetic material so that it will move to open the passage when placed within a magnetic field.

In order to provide such a magnetic field to open the valve, the spout 12 is inserted through the annular actuator 20, as shown in FIG. 3. The actuator comprises a plastic bobbin 70 having two annular end plates 66 and 67 between which extends a tubular central section 68. The outer circumferential surface of the central section 68 of the bobbin 70 has three annular grooves in which three sensing coils 71, 72, and 73 are wound. These coils have relatively few turns (e.g. 50 to 100) and are used to sense whether an associated one of the three spout coding rings 51–53 is metal. Each sensing coil has only one or two layers of wire, thereby causing its wall thickness to be relatively small compared to its inside diameter. Thus, the magnetic field of each sensing coil is concentrated around an inner circumferential surface of the tubular bobbin 70. When actuator 20 is properly positioned about the spout 12, each of the sensing coils 71, 72, and 73 is coaxial with one of the coding rings 51, 52, and 53, respectively. The coding rings are in close proximity to the sensing coils thereby providing essentially single-turn secondary windings inductively coupled to the respective sensing coils. This feature assures that the coding rings 51–53 need only be thin-wall construction in view of their relatively large diameter.

A valve coil 76 is wound on the bobbin 70 in a covering relationship to sensing coils 71–73. The valve coil 76 has a relatively large number of turns (e.g. 800 to 1,600) through which a sizeable current is passed, producing a maximum number of ampere turns, thus generating a strong magnetic field inside the actuator 20. A large initial current in the valve coil 76 is used to move the valve member 56 away from valve seat 64 (FIG. 2), and thereafter a smaller holding current maintains the valve open with the valve member against lug 60. The actuator 20 also includes a mercury-type tilt switch 78 which provides a signal when the assembly is oriented in the pouring position shown in FIG. 1.

The structure disclosed thus far is similar to that found in the previous liquor dispensing system described in U.S. Pat. No. 3,920,179, which description is incorporated herein by reference. As mentioned previously, that system provided only three coding rings, such as rings 51, 52, and 53 and thus limited the number of possible classification codes to eight in number. Because of the relatively large installed base of such systems and in particular the large number of spouts having three coding rings, it is not always practical to replace an entire system simply to provide a greater number of classifications.

Figure 4:
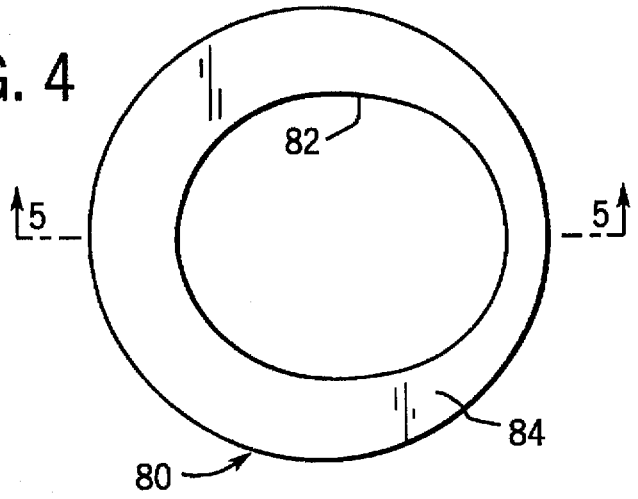
FIG. 4 is a top view of a supplemental coding ring for a spout to encode additional classifications.
Figure 5:
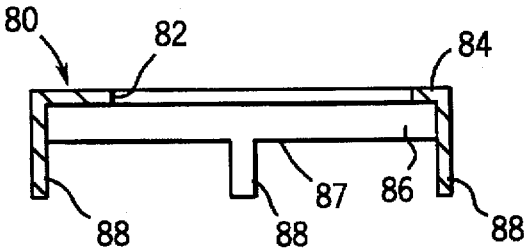
FIG. 5 is cross section along line 5—5 in FIG. 4.

As a result, the present invention is directed toward retrofitting such earlier three-ring systems to provide more classifications. With reference to FIG. 2, the spout 12 can be modified by attaching a supplemental coding ring 80 to the exterior flange 46 at the interface between the interior and exterior tubular sections of the spout. The details of this supplement coding ring 80 are shown in FIGS. 4 and 5. This coding ring 80 has a plate 84 with a circular outer edge and an oval aperture 82 offset to one side. The orientation and oval shape of the aperture 82 corresponds with the eccentric relationship between the interior and exterior sections of the spout 12. A flange skirt 86 extends downward in FIG. 5 from the outer edge of the plate 84 and four fastening tabs 88 project further downward from the bottom edge 87 of the skirt flange 86.

As shown in FIG. 2, when the supplemental coding ring 80 is attached to the spout 12, the fastening tabs 88 are bent around the outside edge of the exterior flange 46 to secure the supplemental coding ring thereto. It will become apparent that the supplemental coding ring will not be attached to all of the spouts, but is used to provide another binary coding digit on selected spouts. For example, the absence of the supplemental coding ring 80 can be utilized along with the combinations of non-magnetic plastic and magnetic metal coding rings 51–53 to indicate numerical classifications zero through seven, while the attachment of the supplemental coding ring 80 is utilized along with coding rings 51–53 to indicate numerical classifications eight through fifteen as defined by Table 1. Each numerical classification can correspond to a price on the type of liquid in the bottle to which a given spout is attached.

TABLE 1

| CLASS | SUPPLEMENTAL METAL RING 80 | FIRST RING 51 | SECOND RING 52 | THIRD RING 53 |
|---|---|---|---|---|
| 0 | Absent | Plastic | Plastic | Plastic |
| 1 | Absent | Plastic | Plastic | Metal |
| 2 | Absent | Plastic | Metal | Plastic |
| 3 | Absent | Plastic | Metal | Metal |
| 4 | Absent | Metal | Plastic | Plastic |
| 5 | Absent | Metal | Plastic | Metal |
| 6 | Absent | Metal | Metal | Plastic |
| 7 | Absent | Metal | Metal | Metal |
| 8 | Present | Plastic | Plastic | Plastic |
| 9 | Present | Plastic | Plastic | Metal |
| 10 | Present | Plastic | Metal | Plastic |
| 11 | Present | Plastic | Metal | Metal |
| 12 | Present | Metal | Plastic | Plastic |
| 13 | Present | Metal | Plastic | Metal |
| 14 | Present | Metal | Metal | Plastic |
| 15 | Present | Metal | Metal | Metal |

With reference to FIG. 3, the actuator 20 further includes a fourth sensing coil 74 wound inside the bobbin end plate 66 which abuts the supplemental coding ring 80 when the spout 12 is inserted fully into the actuator 20. This places the fourth sensing coil 74 adjacent the ferromagnetic supplemental coding ring 80 thus providing essentially a single-turn secondary winding that is inductively coupled to the fourth sensing coil. The sensing coils 71–74, valve coil 76 and tilt switch 78 are connected by wires through cable 24 to the computer 26.

Figure 6:
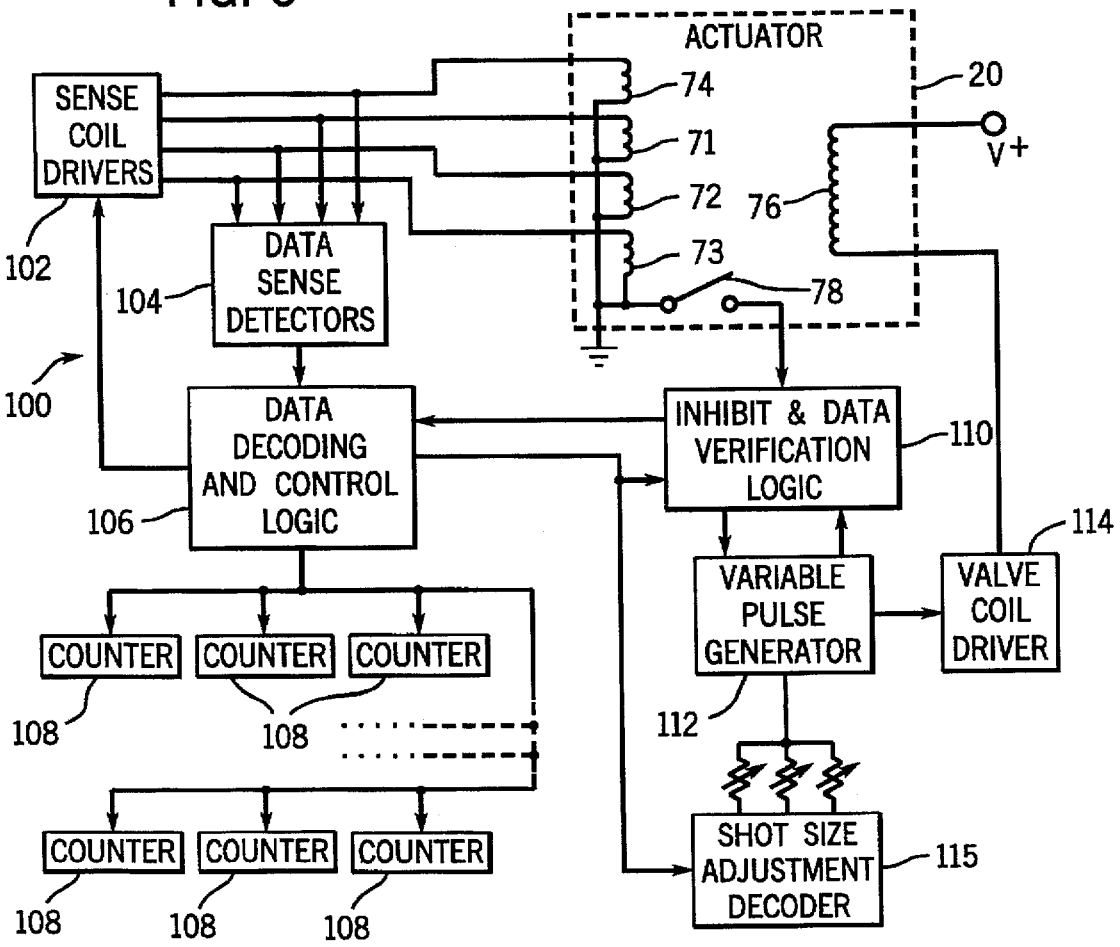
FIG. 6 is a schematic diagram of the computer which activates the spout valve and reads the classification data.

The circuitry for computer 26 of the dispensing system 10 is shown in FIG. 6 with the understanding that some of the functionality of the circuitry could be implemented with software in a programmable microcomputer. The sensing coils 71–74 are energized individually by sense coil drivers 102 and are coupled to data sense detectors 104 which respond to the inductive load on the sensing coils to determine the classification encoded by the combination of spout coding rings 51–53 and 80. A signal indicating the classification code is sent to data decoding logic which activates a corresponding one of a plurality of decade counters 108, which could be implemented with software, to register delivery of an individual quantity of that type of liquor.

Tilt switch 78 in the actuator 20 is connected to inhibit and data verification logic 110 which activates the circuitry to read the type code from the spout. The inhibit and data verification logic 110 sends an enabling signal to the data decoding and control logic and in response receives back an acknowledgement that a classification code has been read from a spout. Receipt of the acknowledgement causes the inhibit and data verification logic to activate a variable time pulse generator 112 and energize the valve coil 76 via a driver 114. The duration of the output pulse from generator 112 can be varied to alter the period that the spout valve is held open, and thereby the quantity of beverage poured.

When the bartender seeks to dispense a drink from a particular bottle 16, the bottle is picked up from its storage location and the spout 12 on the bottle is inserted into the opening in the annular actuator 20 as shown in FIGS. 1 and 3. The bottle then is inverted with the spout 12 facing downward over a glass 22 or other vessel into which the liquor 18 in the bottle will be poured. This inverting action causes the ball of mercury 77 within the tilt switch 78 to drop away from the switch contacts thereby opening the conductive path to the input of the inhibit and data verification logic 110. This input goes to a high logic level due to an internal pull up resistor (not shown) which signals the dispensing system that the actuator 20 has been inverted.

In response, the inhibit and verification logic 110 sends an enabling signal to the data decoding and control logic 106 which in turn activates the sense coil drivers 102. The sense coil drivers sequentially apply a current through each of the four sense coils 71–74 to detect the presence or absence of a metal coding ring at the corresponding location on the bottle spout 12. Specifically, the presence of a metallic coding ring adjacent a given sensing coil 71–74 alters the inductive loading of that coil which can be observed by the data sense detectors 104. Thus, as each sensing coil 71–74 is energized by the sense coil drivers 102, the data sense detectors acquire information whether each of the coding rings 51–53 and 80 on the bottle spout 12 is plastic or metal. That information is then transferred to the data decoding and control logic circuit 106 where the data is decoded to determine the class of the liquor being dispensed.

In order to prevent erroneous activation of the system 10 when a bottle is not present, at least one of the three coding rings 51–53 or supplemental coding ring 80 must be metallic in order for the system to distinguish when a bottle is present and when a bottle is not present. Therefore, class zero (see Table 1) in which all of the coding rings are plastic is invalid since the system cannot distinguish that combination from the absence of a bottle within the tilted actuator 20. This requisite of a fully automated system can be avoided by providing a push button switch on the actuator 20 for depression by the bartender to commence the dispensing operation, which would allow class zero to be utilized.

Upon determining the encoded classification, the data decoding and control logic 106 increments the appropriate counter or counters 108. For example, one counter may be designated for each of the fifteen active classifications and an additional counter can be used to tabulate the total number of drinks dispensed by actuator 20. The data decoding and control logic 106 also sends a signal to inhibit and data verification logic 110, and to the shot size adjustment decoder 115. In response to these signals, the variable pulse generators 112 are activated to apply an enable pulse to the valve coil driver 114 which energizes the valve coil 76. This causes the valve coil 76 to produce a magnetic field within the central opening of the actuator 20 which causes the valve member 56 in FIG. 2 to move upward away from valve seat 64 thereby opening a passage for the alcoholic beverage 18 to flow through the spout into glass 22. The variable pulse generator 112 activates the valve coil driver 114 for a period of time that corresponds to the particular shot size for the decoded type of liquor. When the period terminates, the valve coil driver 114 is disabled thereby de-energizing the valve coil 76 which terminates the magnetic field. Without the presence of the counteracting magnetic field, the force of spring 58 within the spout 12 closes the valve member 56 against a valve seat 64 cutting off the flow of the beverage.

It is possible that the actuator 20 could be inverted without the presence of a bottle spout. Thus, the tilt switch 78 would signal the inhibit and data verification logic 110 to begin sensing the material of coding rings 51–53 and 80. However, since no metallic coding ring will be present adjacent any of the sensing coils 71–74, the data sense detectors 104 will send data to the decoding and control logic 106 which will be interpreted as class zero, i.e. all plastic or non-metallic coding rings. Since this is an invalid class, the data decoding and control logic will not enable the circuits which open the spout valve.

The present invention provides a mechanism for adding a fourth coding ring to spouts 12 which were previously designed for only a three coding ring system. Such addition of a fourth coding ring allows spout of the three coding ring design to be used with actuators 20 that can read four coding rings. As a consequence of the unique design of the supplemental coding ring 80 and its attachment to the spout 12, spouts in installed systems can be easily converted for use with a four coding ring dispensing system. Thus, the computer 26 and the actuator 20 need only be replaced in order to convert and install system to read twice as many classes of liquor. The existing four coding ring spouts in a tavern can be adapted to the new four coding ring dispensing system by merely adding the supplemental coding ring 80 to those spouts to be coded for the additional classes. As a consequence, the present invention enables the cost effective conversion of an existing three coding ring dispensing system to a four coding ring system without having to replace all of the spouts already utilized by the tavern.

I claim:

1. A liquid dispensing system comprising:

a spout with an attachment portion to engage a liquid container, a cylindrical portion extending along a first axis from the attachment portion, an external flange where the cylindrical portion extends from the attachment portion, and a flow passage controlled by a magnetically operable valve in the cylindrical portion;

a given plurality of rings attached around and spaced axially along the cylindrical portion of said spout, wherein magnetic properties of the rings define a code which classifies contents of the liquid container;

a supplemental ring of a magnetic material attached to the flange on an exterior of said spout, said supplemental ring further defining the code;

an actuator having an annular shape with a second axis and an aperture within which to detachably receive the cylindrical portion of said spout, said actuator including a given plurality of sensing coils wound around the aperture and spaced along the second axis, and including a valve coil wound around the aperture to produce a magnetic field which opens the magnetically operable valve, said actuator further having a supplemental sensing coil located to detect presence of a supplemental ring when said spout is received in the aperture; and a controller connected to the given plurality of sensing coils and the supplemental sensing coil to read the code from the spout and energize the valve coil to open the valve.

2. The liquid dispensing system as recited in claim 1 wherein said supplemental ring has at least one member which engages the flange to secure the supplemental ring to said spout.

3. The liquid dispensing system as recited in claim 1 wherein said actuator comprises a bobbin having first and second end plates with a tubular member there between with the aperture extends through the tubular member, wherein the first end plate abuts the external flange when the spout is received in the aperture, the given plurality of sensing coils and the valve coil being wound around the tubular member, and the supplemental sensing coil is wound around the tubular member against the first end plate.

4. The liquid dispensing system recited in claim 1 wherein said supplemental ring has a plurality of tabs which extend at least partially around the flange to attach the supplemental ring to said spout.

5. The liquid dispensing system as recited in claim 4 wherein said supplemental ring further comprises a plate with an outer edge and a ring aperture through the plate, a tubular skirt extending from the outer edge of the plate with the plurality of tabs projecting from the flange skirt.

6. The liquid dispensing system as recited in claim 5 wherein the ring aperture is oval shaped.

7. In a liquid dispensing system of a type which includes:

a spout with an attachment portion for engaging a liquid container, a cylindrical portion extending from the attachment portion, and a flow passage controlled by a magnetically operable valve in the cylindrical portion;

three rings extending around and fixedly spaced along the cylindrical portion of said spout wherein magnetic properties of the three rings define a code which classifies contents of the liquid container; and an actuator having an tubular member within which to detachably receive the cylindrical portion of said spout, the tubular member having an axis along which are spaced three sensing coils wound around the tubular member, and including a valve coil wound around the tubular member to produce a magnetic field which opens the valve; an improvement comprising:

a supplemental ring of magnetic material with an opening through which the cylindrical portion extends, and secured to an exterior of the spout at an interface between the attachment and cylindrical portions; and said actuator further including a fourth sensing coil wound around the tubular member at an end that abuts the supplemental ring when said spout is received in the actuator.

8. The liquid dispensing system as recited in claim 7 wherein said supplemental ring includes at least one tab for bending around part of said spout to secure the supplemental ring thereto.

9. The liquid dispensing system as recited in claim 7 wherein said opening in the supplemental ring is oval.

10. The liquid dispensing system as recited in claim 7 wherein said spout further comprises an exterior flange; and said supplemental ring includes a plurality of tabs bent around the exterior flange to secure the supplemental ring thereto.

11. The liquid dispensing system as recited in claim 10 wherein said supplemental ring further comprises a plate abutting the external flange with an outer edge and a ring aperture through the plate, a tubular skirt extending from the outer edge of the plate with the plurality of tabs projecting from the flange skirt.

12. A supplemental coding ring for a spout of a liquid dispensing system wherein said spout includes a tubular attachment portion for engaging a liquid container, a tubular dispensing portion extending from the attachment portion at an interface, and a magnetically operable valve which controls liquid flow through the dispensing portion, the spout further comprising three primary rings extending around and fixedly spaced along the dispensing portion of said spout wherein magnetic properties of the three primary rings define a code which classifies contents of the liquid container; said supplemental coding ring comprising:

a body of magnetic material with an opening in which to receive the dispensing portion of the spout and a fastener for securing to an exterior of the spout at an interface between the attachment and dispensing portions, said supplemental coding ring cooperates with the three primary rings to define the code.

13. The liquid dispensing system as recited in claim 12 wherein said body of the supplemental ring comprises a plate having an outer edge and a ring aperture extends through the plate, and having a tubular skirt extending from the outer edge of the plate with the fastener formed by a plurality of tabs projecting from the flange skirt.

14. The liquid dispensing system as recited in claim 13 wherein the ring aperture in the plate is oval shaped.

* * * * *